United States Patent [19]

May et al.

[11] Patent Number: 4,463,466

[45] Date of Patent: Aug. 7, 1984

[54] MATTRESS CONSTRUCTION AND METHOD

[75] Inventors: George C. May, Greenwood; Robert G. May; Lawrence T. May, both of Indianapolis, all of Ind.

[73] Assignee: May and Co., Inc., Indianapolis, Ind.

[21] Appl. No.: 319,455

[22] Filed: Nov. 9, 1981

[51] Int. Cl.[3] ..... A47C 27/05; A47C 27/045

[52] U.S. Cl. ..... 5/475; 5/478

[58] Field of Search ..... 5/475, 476, 474, 478, 5/479, 460

[56] References Cited

U.S. PATENT DOCUMENTS

| | | | |
|---|---|---|---|
| 2,200,011 | 5/1940 | Riley . | |
| 2,738,834 | 3/1956 | Jaffe et al. | 5/420 |
| 2,838,771 | 6/1958 | Goodman et al. . | |
| 3,173,159 | 3/1965 | Hart | 5/474 |
| 3,429,767 | 2/1969 | Bronstien et al. . | |
| 3,728,747 | 4/1973 | Docker | 5/460 |
| 3,924,283 | 12/1975 | Shave | 5/434 |
| 4,019,451 | 4/1977 | Autrey | 112/262 |
| 4,245,363 | 1/1981 | Callaway | 5/451 |
| 4,286,344 | 9/1981 | Ikeda | 5/474 |

*Primary Examiner*—Alexander Grosz

*Attorney, Agent, or Firm*—Woodard, Weikart, Emhardt & Naughton

[57] ABSTRACT

A mattress construction is disclosed herein which includes a base comprising a spring unit and a padding mounted thereto, a sheet material received over the padding and secured by means of a flange material to the spring unit and retaining the padding thereon. A sheet of padding material is glued onto the sheet material and a cover is glued over the sheet of padding material and secured to the sheet material.

8 Claims, 3 Drawing Figures

MATTRESS CONSTRUCTION AND METHOD

BACKGROUND OF THE INVENTION

1. Field of the Invention

The present invention relates to the field of mattress constructions and methods therefor, and more particularly relates to a method for the construction of a mattress to provide the appearance of a separate, but attached, to cushion.

2. Description of the Prior Art

Various methods and constructions for mattresses have been provided in the prior art. Typically, the construction of a mattress will include a spring unit which is covered by successive layers of padding and cushioning materials, and finally covered by a cover material to provide the desired aesthetic appearance of the mattress. One or more of the lower layers is typically secured to the spring unit by the use of rings, known in the field as "hog rings." The upper layers are typically quilted together by sewing.

In U.S. Pat. No. 2,838,771, issued to Goodman et al. on June 17, 1958, there is a shown a mattress which includes three layers of padding material secured to the spring unit with the use of a ticking material. The combination of pad and ticking layers is disclosed in U.S. Pat. No. 4,245,363, issued to Callaway on Jan. 20, 1981.

In U.S. Pat. No. 4,019,451, issued to Autrey on Apr. 26, 1977, there is disclosed the typical use of a side tape or ribbing for connecting the edges of materials used in mattresses. Also disclosed in the Autrey patent is the combination of sisal matting, foam padding and a fabric cover backed by ticking. The combination of a sisal layer, filling cotton layer and cushioning material is also disclosed in U.S. Pat. No. 2,200,011, issued to Riley on May 7, 1940. The use of adhesives in securing materials in a mattress construction is shown in U.S. Pat. No. 3,429,767, issued to Bronstien on Feb. 25, 1969.

SUMMARY OF THE INVENTION

Briefly described in one aspect of the present invention, there is provided a mattress construction which includes a base having a spring unit and a padding mounted to the spring unit, a sheet material positioned over the padding and secured to the spring unit, padding glued to the top of the sheet material, and a cover positioned over the padding and secured to the shet material. In another aspect of the present invention there is provided a method for the construction of a mattress of the described type.

It is an object of the present invention to provide a mattress construction which has a novel and desirable outward appearance.

Another object of the present invention is to provide a mattress construction which includes the firm interconnection of the padding material to provide a desired feel and durability for the mattress.

It is a further object of the present invention to provide a method for the construction of a novel mattress, which method is easily and inexpensively performed.

Further objects and advantages of the present invention will become apparent from the description of the preferred embodiment which follows.

DESCRIPTION OF THE PREFERRED EMBODIMENT

Figure 1:
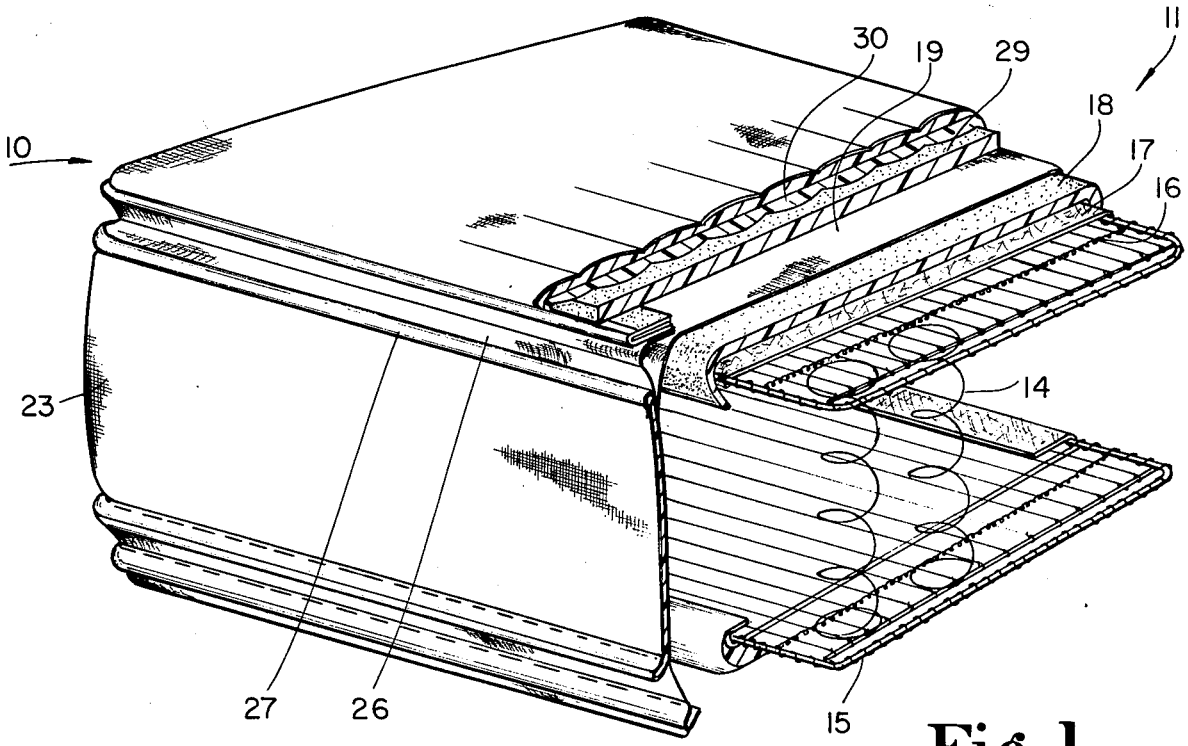
FIG. 1 is a perspective, sectional view of a mattress constructed in accordance with the present invention.
Figure 3:
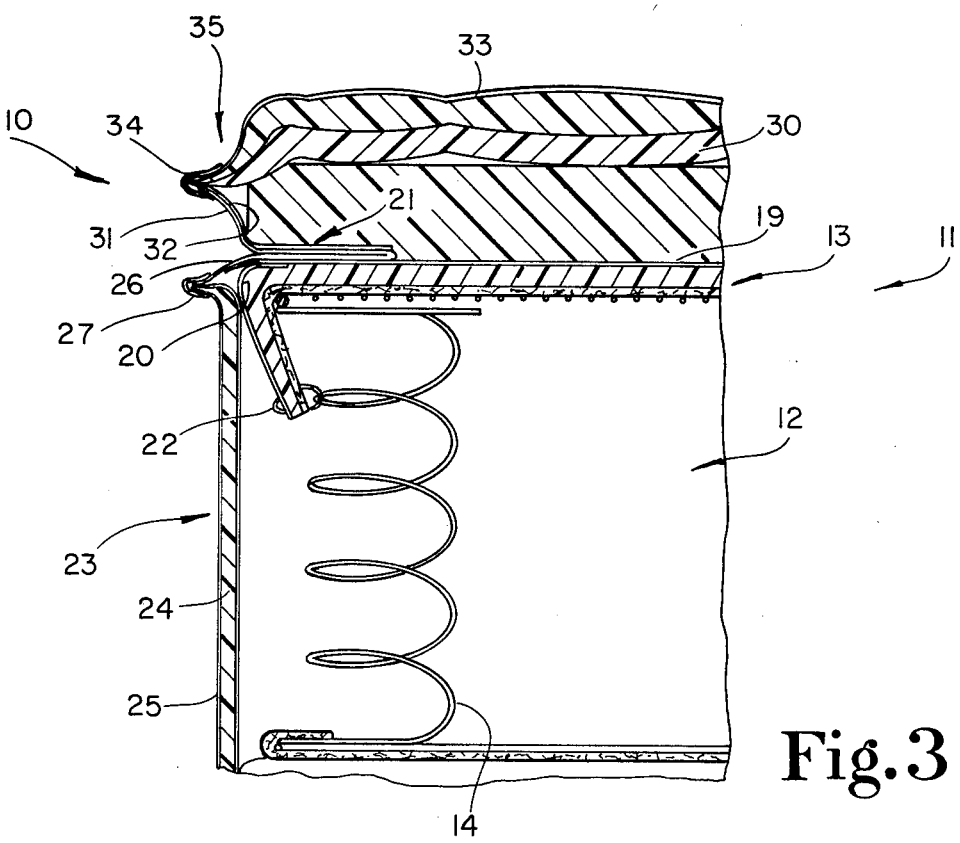
FIG. 3 is a partial, cross-sectional view of a mattress constructed in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to the drawings, there is shown a mattress 10 constructed in accordance with the present invention. The mattress 10 includes a base 11 which comprises a spring unit 12 and a padding 13 mounted onto the spring unit. The spring unit may be any of a variety of constructions such as those typically used in the prior art. A typical and preferred construction for the spring unit 12 is the inclusion of an array of springs 14 secured between spring frames 15. A permalator 16, consisting of a grid of parallel wires, is preferably attached to the spring frames and may preferably be provided only in the middle third of the mattress to provide additional support in that region. It will be appreciated that in the foregoing description as well as that which follows, the mattress is preferably constructed in the same fashion both along the top and the bottom, and the description will therefore only be made with respect to the top half of the mattress.

The padding mounted to the spring unit may also comprise a variety of materials and layers selected to give the desired feel to the mattress. In the preferred embodiment, there is provided an insulating pad 17 which comprises a matting of rubberized coconut fiber such as the ones sold under the trademark coirtex. Over the pad 17 there is provided a polyurethane pad 18 which preferably has a thickness of one-half inch, a density of 1.20 pounds per cubic foot.

As a particular aspect of the present invention, there is provided a retaining means retaining the padding of the base to the spring unit of the base. This retaining means includes a sheet material 19 which is positioned over the padding 13 and is secured to the spring unit 12. Preferably, each of the pad layers 17 and 18 and a sheet material 19 are secured to the spring unit, such as by attachment to individual springs by means of hog rings 22. Most preferably, a spring flange material 20 is secured to the sheet material, such as by sewing along the location 21. The spring flange material 20 is then used to secure the sheet material to the spring unit such as by means of the hog rings 22.

In typical fashion, there is provided a side covering 23 to the mattress which typically includes a padding material 24 and a cover 25. In the preferred construction of the mattress, the sheet material 19 is secured to the side padding 24 and cover 25. More particularly, a flange material 26 is secured to the sheet material 19, such as by sewing along location 21, and both the sheet material 19 and flange material 26 are secured to the side padding and cover. A tape 27 is positioned over each of these materials and is sewed thereto along a line 28, thus providing the typical and desirable seem appearance for these members.

As a further and particular aspect of the present invention, there is provided a padding means for providing padding material on top of the base. More particularly, the padding means includes at least one sheet of padding material glued to the sheet material and to the cover 33. As shown in the drawings, the preferred construction includes a layer of upholstery foam 29 having a thickness of one and one-fourth inches, a density of 1.50 pounds per cubic foot. There are also provided two layers 30 of quilted foam, although these more accurately comprise a portion of the cover.

Figure 2:
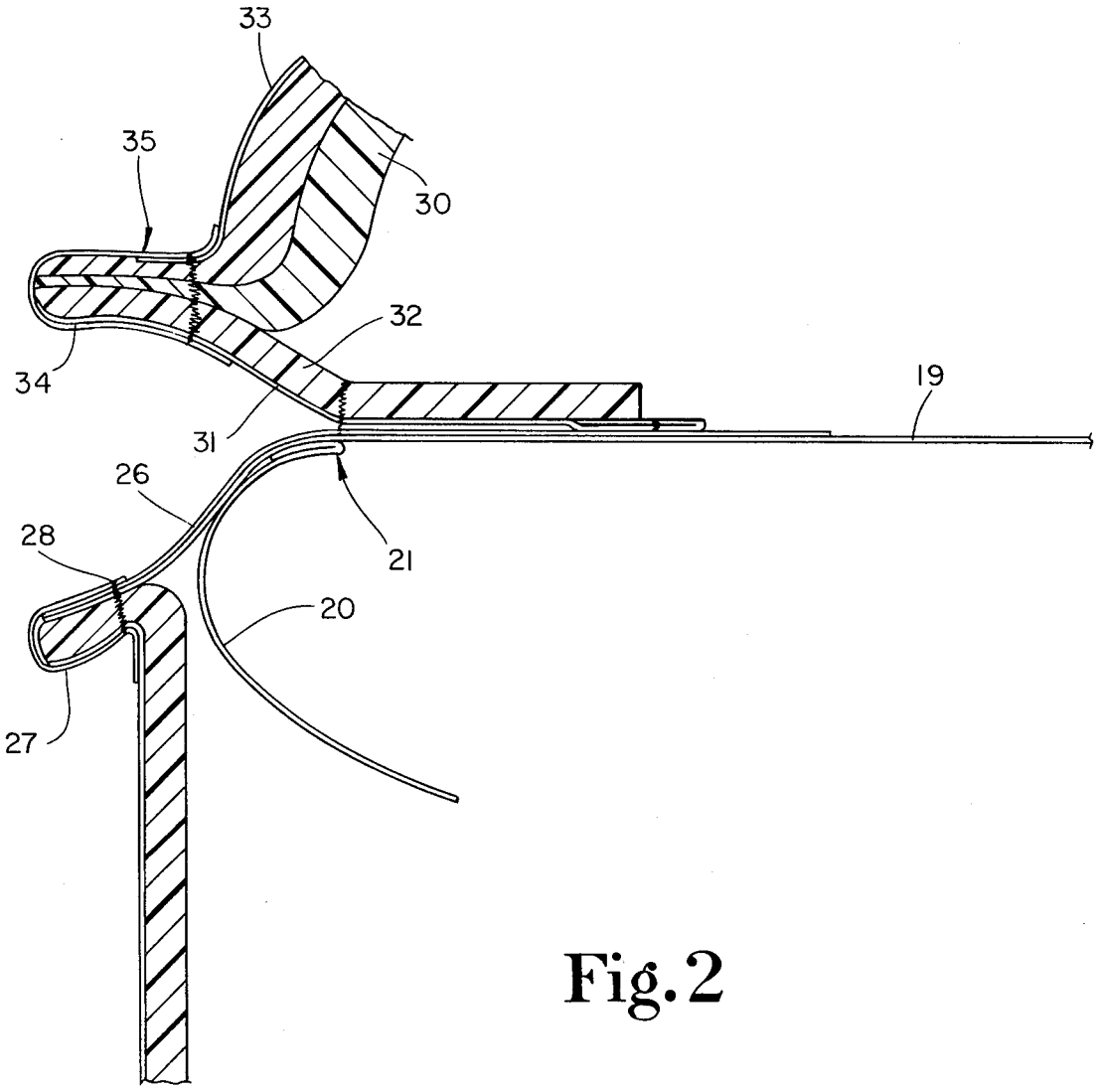
FIG. 2 is a partial, cross-sectional view of a sheet material and associated components used for securing together many of the components of the present invention mattress.

As a final aspect of the present invention, there is provided a cover 33 which is positioned over and glued to the padding material 29 and is secured to the sheet material 19. The cover 33 is quilted by sewing to the two foam layers 30. A strip of fabric or cover flange material 31 is sewed to the sheet material 19 is also secured such as by sewing to a foam layer 32. As shown particularly in FIG. 2, the cover 33, foam layers 30 and 32 and the fabric 31 are secured together by means of a tape 34 received over the respective ends of these components and sewed to them along a line 35.

As noted, the one or more sheets of padding material secured on top of the sheet material 19 and to the bottom of cover 33 are secured to the sheet material and to the cover by means of glue. Various types of glue are well known for use in conjunction with foam materials, such as polyurethanes, and these may be applied such as by spraying onto the mutually facing surfaces of the padding 29 and the sheet material 19. The cover 33 is then received over the padding layer 29 and after spraying onto the mutually facing surfaces of the padding 29 and cover 33, is secured by sewing along the edges to the sheet material, or more particularly a cover flange material 31 secured to the sheet material. These features are in distinct contrast to the prior art, in which the cover in the prior art mattress would typically take the place of the sheet material 19, and all paddings would then be received below this cover and secured directly to the spring unit such as by means of the hog rings. The gluing of the padding material 29 to the top of the sheet material and to the bottom of the cover provides for a firm and durable mattress construction which has the desirable effect of providing what appears to be a separate cushion attached onto a mattress.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A mattress which comprises:

a base including a spring unit and a padding mounted to the spring unit;

retaining means for retaining the padding to the spring unit, said retaining means including a sheet material positioned over the padding and secured to the spring unit;

a padding material positioned on top of said base, said padding material being glued to the sheet material of said retaining means; and a cover positioned over said padding material, said cover being glued to said padding material and being secured to the sheet material of said retaining means.

2. The mattress of claim 1 in which said retaining means includes a spring flange material secured at one location to the sheet material and at a second location to the spring unit.

3. The mattress of claim 1 in which said cover includes a cover flange material secured at one location to the sheet material and at a second location to said cover.

4. The mattress of claim 1 in which said base includes a side cover, and in which the sheet material is secured to the side cover.

5. The mattress of claim 4 in which said cover includes a cover flange material secured at one location to the sheet material and at a second location to said cover.

6. The mattress of claim 5 in which said retaining means includes a spring flange material secured at one location to the sheet material and at a second location to the spring unit.

7. The mattress of claim 5 in which said cover includes a layer of quilted foam padding.

8. A method for making a mattress which comprises the steps of:

a. preparing a base including a spring unit and a padding mounted to the spring unit;

b. positioning a sheet material over the padding and securing the sheet material to the spring unit to retain the padding in place;

c. gluing a padding material onto the sheet material; and d. gluing a cover over the padding material and securing the cover to the sheet material.

* * * * *